US006675978B2

(12) United States Patent
Shea

(10) Patent No.: US 6,675,978 B2
(45) Date of Patent: Jan. 13, 2004

(54) THREE SIDED AND EXTENDED MERCHANDISING DISPLAY WITH INSERTION CHANNELS FOR PRODUCT IDENTIFICATION AND ADVERTISEMENT

(76) Inventor: Thomas M. Shea, 984 Livernois, Troy, MI (US) 48083

( * ) Notice: Subject to any disclaimer, the term of this patent is extended or adjusted under 35 U.S.C. 154(b) by 0 days.

(21) Appl. No.: 10/091,043

(22) Filed: Mar. 4, 2002

(65) Prior Publication Data

US 2003/0164346 A1 Sep. 4, 2003

(51) Int. Cl.[7] ..... B42F 1/00

(52) U.S. Cl. ..... 211/59.1; 211/57.1; 211/181.1; 211/86.01; 211/189

(58) Field of Search ..... 211/57.1, 189, 211/181.1, 59.1, 103, 86.01, 87.01, 192; 248/174, 152, 300, 220.31, 220.41, 220.42, 220.43; 312/108, 128, 257.1, 258, 262, 265.1–265.5; 40/642.02, 657, 672; 403/DIG. 11, DIG. 13, DIG. 14, 364; 24/67.3, 67 R, 346, 326, 455, 522, 545

(56) References Cited

U.S. PATENT DOCUMENTS

| | | | | | |
|---|---|---|---|---|---|
| 3,001,678 | A | * | 9/1961 | Maxwell | 224/600 |
| 4,167,903 | A | * | 9/1979 | Lasher | 100/34 |
| 4,300,299 | A | * | 11/1981 | Batky et al. | 40/607 |
| 4,733,782 | A | * | 3/1988 | Spezial et al. | 211/57.1 |
| D328,398 | S | * | 8/1992 | Benedetto | D6/436 |
| 5,509,225 | A | | 4/1996 | Minh et al. | 40/611 |
| 5,584,406 | A | * | 12/1996 | Besserer et al. | 211/189 |
| 5,615,851 | A | * | 4/1997 | LeBeau | 248/73 |
| 5,620,104 | A | * | 4/1997 | Maglione | 211/59.1 |
| 5,683,003 | A | | 11/1997 | Gebka | 211/57.1 |
| 5,758,988 | A | * | 6/1998 | Theodorou | 403/331 |
| 5,908,119 | A | * | 6/1999 | Kump et al. | 211/113 |
| 6,024,230 | A | | 2/2000 | Menaged et al. | 211/87.01 |
| 6,098,818 | A | * | 8/2000 | Ali et al. | 211/50 |
| 6,142,316 | A | | 11/2000 | Harbour et al. | 211/59.2 |
| 6,202,866 | B1 | * | 3/2001 | Shea | 211/87.01 |
| 6,206,212 | B1 | * | 3/2001 | Loew | 211/189 |
| 6,226,910 | B1 | | 5/2001 | Ireland | 40/661.03 |
| 6,234,330 | B1 | * | 5/2001 | Gray | 211/106 |
| 6,299,001 | B1 | * | 10/2001 | Frolov et al. | 211/106 |
| 6,349,507 | B1 | * | 2/2002 | Muellerleile | 52/36.5 |
| 6,390,337 | B1 | * | 5/2002 | Shea | 222/181.2 |
| 6,401,941 | B1 | * | 6/2002 | Maumus | 211/59.1 |
| 2002/0033372 | A1 | * | 3/2002 | Kellogg | 211/13.1 |
| 2002/0175132 | A1 | * | 11/2002 | Shea | 211/87.01 |

* cited by examiner

*Primary Examiner*—Daniel P. Stodola
*Assistant Examiner*—Jennifer E. Novosad
(74) *Attorney, Agent, or Firm*—Gifford, Krass, Groh, Sprinkle, Anderson & Citkowski, P.C.

(57) ABSTRACT

A product display assembly for use with an upwardly extending support surface, such as a wing rack assembly having a surface defined by a plurality of spaced apart grid portions. A planar shaped and elongate extending back panel includes a plurality of apertures formed therethrough at spaced apart intervals, the apertures receiving inserting and engaging ends of product display hangers. First and second side panels are provided, each likewise planar shaped and elongate extending, and each further exhibiting an arcuate shape in cross section. Clasp portions are defined along the arcuate extending edges of the side panels and receivingly engage opposite extending side edges of the back panel insertingly received between inwardly facing surfaces of the clasp portions. Spaced apart and opposing channel defining portions extend from outwardly facing surfaces of the side panels for supporting and displaying advertisement placards.

12 Claims, 7 Drawing Sheets

THREE SIDED AND EXTENDED MERCHANDISING DISPLAY WITH INSERTION CHANNELS FOR PRODUCT IDENTIFICATION AND ADVERTISEMENT

BACKGROUND OF THE INVENTION

1. Field of the Invention

The present invention relates generally to merchandise display assemblies. More particularly, the present invention discloses a product display assembly, having a substantially "U" shape in cross section, and being constructed of individual and planar shaped back and side panels. The back panel is capable of being secured to a vertically extending and existing merchandising display surface and includes apertures at spaced apart intervals for receiving product hangers. The side panels are further interlockingly engaged along opposite edges of the back panel and each is further capable of supporting insert graphics/advertisements associated with volumes of merchandise supported upon the product hangers.

2. Description of the Prior Art

The prior art is well documented with examples of merchandising display assemblies. Conventional merchandise displays are typically provided in the form of gondola units having horizontal shelving portions. Such existing gondola displays further include features such as side and edge wing rack assemblies.

Due to limitations in the product carrying capacity of existing gondola displays, attempts have been made to increase the capacity of the existing gondola display through the provision of additional displays, typically those attachable to the existing gondola. An example of such a merchandising display is illustrated in U.S. Pat. No. 6,024,230, issued to Menaged et al., and which teaches a vertically extending and substantially tubular display member spaced a given distance from the gondola by a series of interconnecting and horizontal extending support members. An additional example of such a merchandising display is disclosed in U.S. Pat. No. 5,660,286, issued to Shea.

The nature of the merchandising display assemblies as shown in Menaged and Shea is their particular ability to project and space the vertical display portion a distance from the forward facing edge of the gondola display. As such, these display assemblies are not well suited for securing to the side or aisle edge locations of the gondola, and in particular to existing wing rack assemblies which may be associated with the gondola upright displays. This is so in particular because the space requirements along the aisle edges are much tighter than between the aisles and, given the configuration of the prior art merchandising displays, the possibility of accidental damage and/or injury exists. Additionally, conventional merchandising displays usually do not provide adequate product identification or advertisement indicia, these often being critical in the ability to successfully market impulse and point-of-sale merchandise often displayed upon such merchandise extension assemblies.

Another example of the relevant prior art is set forth in U.S. Pat. No. 6,142,316, issued to Harbour et al., and which teaches a product merchandising display unit with replaceable product graphics. Harbour teaches a product module including at least one elongated product channel defined by a pair of laterally spaced upstanding side walls and a substantially planar product supporting floor portion extending therebetween. Each product channel includes a product graphic panel which is removably attachable to the front portion of each product channel via different constructional arrangements. Product graphic panels are dimensioned to attach to the front portion of a particular product channel, the graphic panel substantially overlaying the product identification and graphics associated with the lead product container positioned within that particular product channel.

U.S. Pat. No. 5,683,003 issued to Gebka, teaches a strip merchandise hanger and label holder adapted to be removably secured to a horizontally extending shelf and perpendicular to the front edge thereof. The hanger includes a central upstanding label holder, both surfaces of which can be provided with merchandising indicia. A transparent label cover enables the label holder to carry adhesive or non-adhesive labels or signs. A pair of spaced hooks are provided below each label-receiving surface to support, in depending fashion, strip merchandisers carrying a multiplicity of products.

SUMMARY OF THE PRESENT INVENTION

The present invention discloses a product display assembly which is particularly suited for securing to the side or aisle edge locations of a gondola, and in particular to existing wing rack assemblies which may be associated with the gondola upright displays. Alternatively, the product display assembly is capable of being supported in freely upstanding fashion from a floor or counter supporting surface. In either variant, the product display assembly is capable of supporting volumes of typically smaller sized and impulse purchase merchandise and to do so in combination with incorporating unique product advertisement and graphic displays.

The product display includes three individual, assembleable, planar shaped and elongated panels, each typically constructed of an extruded and substantially rigid, plasticized material. The panels include an interconnecting back panel and a pair of opposing side panels which, upon assembly with opposite extending edges of the back panel, defines a substantially "U" shape in cross section.

The back panel is capable of being secured to a vertically extending and existing merchandising display surface, such as again a wing rack display associated with a gondola unit or other conventional shelving support. The back panel includes apertures at spaced apart intervals for receiving product hangers and such as which may secure through the back panel and to appropriate support surfaces located along the wing rack or suitable gondola support.

The side panels are further configured such that they interlockingly engage along opposite edges of the back panel. In the preferred embodiment, the side panels are each arcuately configured in cross section and terminate, along one extending edge thereof, in spaced clasp portions, defining an inward channel therebetween for grippingly receiving the back panel. Outwardly facing surfaces of each of the side panels each further define insert receiving channels, running along their substantial axial length, and which are capable of supporting appropriately sized inserts displaying graphics and/or advertisements associated with the volumes of merchandise supported upon the product hangers.

Additional variants of the invention further include the back panel and side panels being extruded in an integral "U" configuration. Also, it is contemplated that the side panels can be ultrasonically welded to the back panel. In addition to mounting the product display to an aisle way extending wing rack display of a conventional gondola support, additional mounting variants afforded by the present invention include mounting the product display to such as the associated side extending edges of a typical gondola shelving support, as well as to both single slotted and double slotted vertically extending back plate portions of the gondola display.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to FIGS. 1–4, a product display assembly is illustrated at 10 which is particularly suited for securing to the side or aisle edge locations of a gondola 12, and in particular to existing wing rack assemblies, such as referenced at 14 and which may be associated with the gondola upright displays. In particular, the wing rack 14 may be constructed of any overall shape and may include a plurality of interconnected and spaced grid portions, such as referenced at 16, 18, 20, et seq. in FIG. 4.

Figure 4:
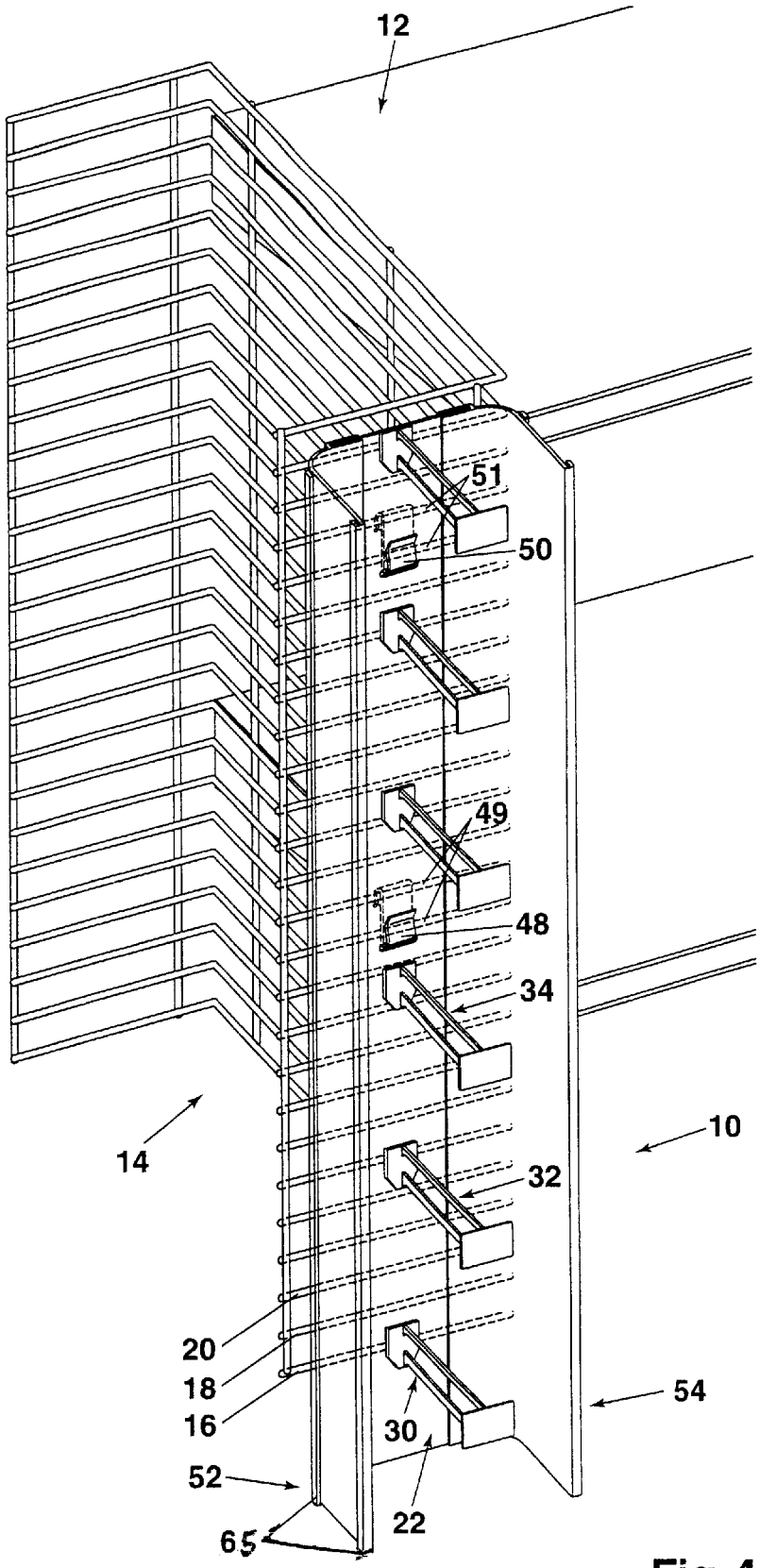
FIG. 4 is a further environmental view, in perspective, of the product display assembly according to the present invention and which is secured to a surface of an edge extending wing rack associated with a conventional gondola upright.

As further best illustrated in FIG. 4, the wing rack 14 is secured to a side edge location of the gondola 12, however it is understood that the product display assembly 10 may be utilized with any suitable upwardly extending support surface. Alternatively, and as previously discussed, the product display assembly is capable of being supported in freely upstanding fashion from a floor or counter supporting surface (not shown). In this fashion, the product display assembly 10 supports volumes of typically smaller sized and impulse purchase merchandise and does so in combination with incorporating unique product advertisement and graphic displays.

Figure 1:
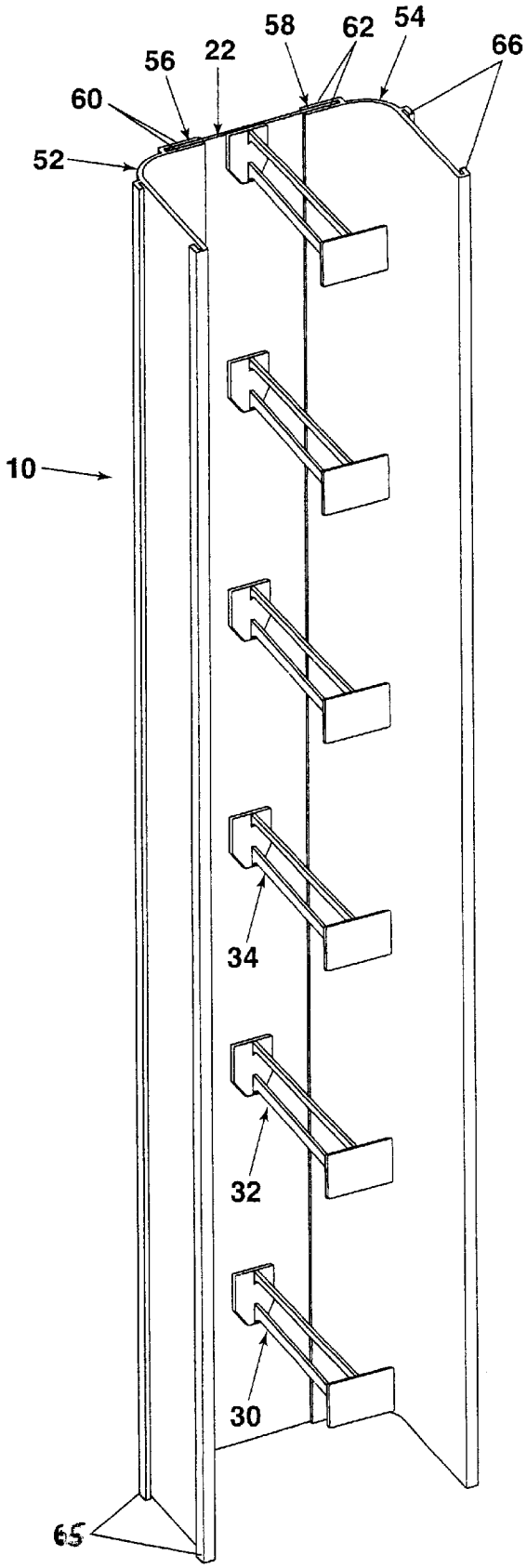
FIG. 1 is an assembled perspective view of the product display assembly according to the present invention.
Figure 2:
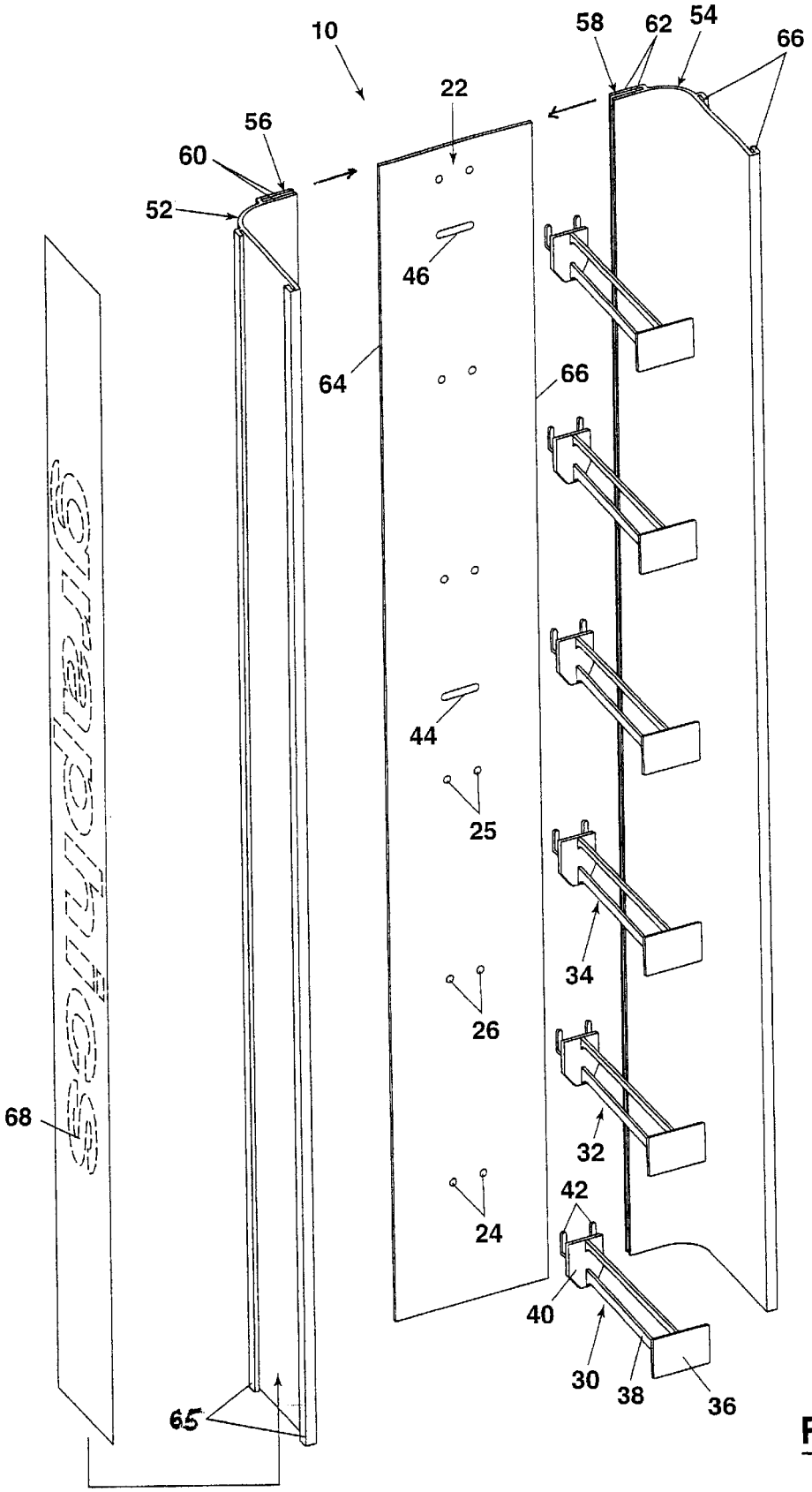
FIG. 2 is an exploded perspective of the product display assembly and showing the manner in which the opposing side panels and product hangers secure to the back panel, as well as the assembly of the product identification/graphics inserts according to the present invention.
Figure 3:
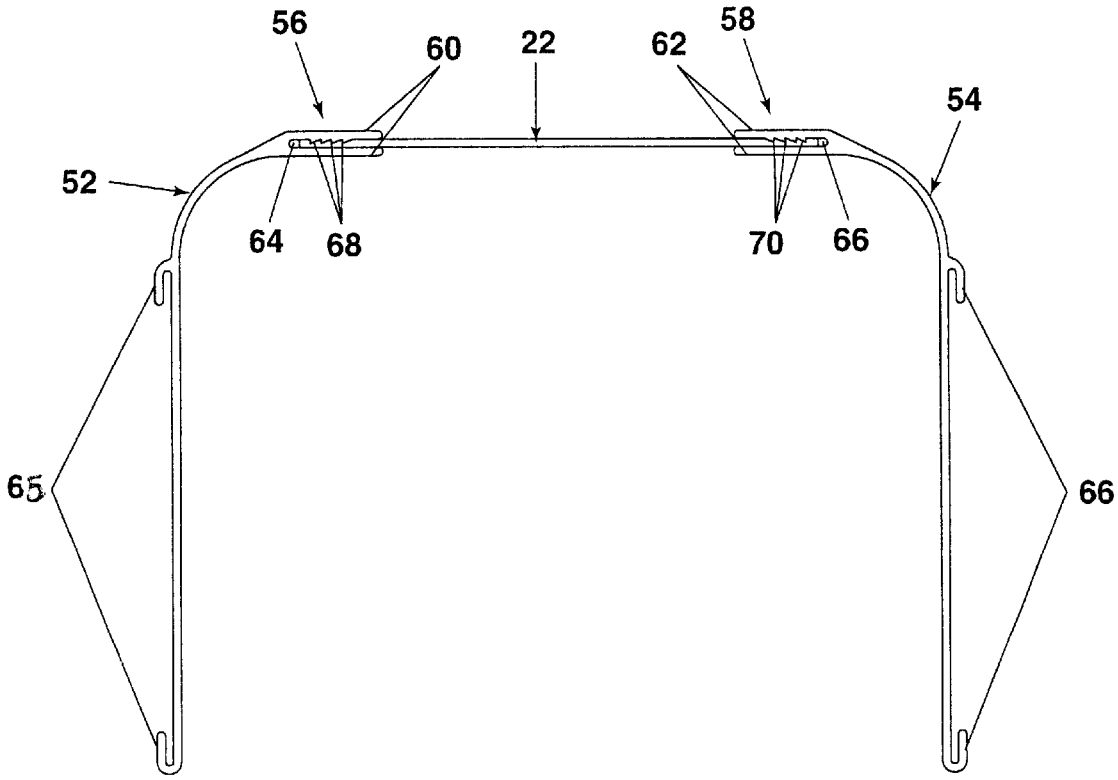
FIG. 3 is a top view of the product display and which illustrates the interlocking relationship of the back panel with the side panels.

A substantially planar shaped and elongate extending back panel 22 is provided, the back panel 22 preferably being constructed of one-piece plasticized extrusion and exhibiting a generally rectangular configuration. It is however also understood that the back panel 22, as well as the remaining components of the product display, may also be constructed of any other appropriate material such as including a lightweight metal or other material. Pluralities of apertures are formed through the back panel at spaced apart intervals and, as best illustrated in FIG. 2, include individual pairs 24, 25, 26, et seq. of apertures along the overall axial length of the back panel. Merchandise display hangers are illustrated at 30, 32, 34, et seq., and each is configured for engageably receiving through an associated pair of the defined apertures. In particular, and referring specifically to first selected display hanger 30, it includes a miniaturized display portion 36, a merchandise hanger portion 38, a base support portion 40 and a pair of angled tabs 42 which extend rearward from the base support and which insert through the selected pair of apertures defined in the back panel.

Referring again to FIG. 4, an advantage achieved in securing the display assembly 10 against the wing rack 14, through the use of the display hangers 30, 32, 34, et seq., resides in the ability of the angled tabs (e.g. again illustrated at 42 for first selected hanger 30) to abuttingly engage against a rear side of a selected one of the spaced apart grids (see again by example at 16 in FIG. 4). In this manner, the individual hangers acquire the strength of the underlying wing rack 14 in its product carrying capacity and, in combination with the graphics carrying and advertising ability of the product display assembly, provide for extremely effective point of sale merchandising of various types of smaller high-volume products.

Also defined in the back panel 22, at likewise spaced apart intervals, are elongated slots, such as illustrated at 44 and 46, the purpose of the slots being to support mounting clips (see at 48 and 50 in FIG. 4). The mounting clips 48 and 50, as again illustrated in phantom in FIG. 4, are configured in a modified "S" shape and, upon insertion through an associated slot defined in the back panel 22, suspend the display from selected pairs of the wire grids and such as are shown by pairs 49 and 51 of the grids associated with the mounting clips 48 and 50, respectively.

A pair of first 52 and second 54 side panels are provided, each defining an elongate and, for the most part, generally planar shape which is consistent with that of the back panel 22. The side panels 52 and 54 are also preferably constructed of one piece extruded materials, however may further include a bending (generally 90°) extending portion terminating in an arcuate extending edge, such as illustrated generally at 56 for first side panel 52 and at 58 for second side panel 54. It is also understood that the overall configuration of the side and back panels can be according to any desired cross sectional shape, such also including shape 90° bends, generally curved connections, and other types of open facing polygonal cross sections.

Each of the arcuate extending edges 56 and 58 are further defined by spaced clasp portions (see pairs of clasp portions 60 and 62) defined along the respective arcuate extending edges 56 and 58 of the side panels 52 and 54. The opposite extending edges of the back panel 22, see at 64 and 66, insertingly engage between the inwardly facing and predetermined spaced surfaces of said clasp portions 60 and 62. Individual pluralities of serrations 68 and 70 (see in particular the side cutaway of FIG. 3) may extend from at least one of the inwardly facing surfaces of the individual pairs 60 and 62 of clasp portions, the serrations 68 and 70 resistively engaging the inserting side edges of the back panel. It is also contemplated that the ability to assemble the back panel 22 and side panels 52 and 54, in the manner illustrated, provides for easier manufacturing, shipping and product display set-up.

The preferred manner of assembling the side panels 52 and 54 with the opposite side edges 64 and 66 of the rear panel 22 in the manner shown above provides the specific advantage of permitting the product displays to be shipped in bulk (in a disassembled condition) and quickly set up at the retailer location. It is however also envisioned that other assembly variants may be adopted for constructing the overall elongated and "U" shaped body of the product display, these including such as extruding as one piece the "U" shaped body with a desired cross sectional profile. An additional envisioned variant includes, similarly to the disclosed variant, assembling together individual back and side panels, with the further step of ultrasonically welding the side and back panels to achieve the desired integral shape. Other and additional variants are also possible for assembling the product display within the scope of the present invention.

As illustrated in each of the associated figures, spaced apart and opposing channel defining portions are provided along at least the outwardly facing surfaces of the assembled side panels 52 and 54. The channel defining portions are further identified as pairs of opposing and arcuate shaped projections, see at 65 for first side panel 52 and at 66 for second side panel 54.

As best further illustrated in FIG. 2, a graphics/advertisement display, illustrated in reduced length at 68 and typically associated with the merchandise to be carried upon the display, is provided and may be seated against an associated facing surface of a side panel (by reference example to side panel 52) and by slidingly engaging within the channel defined between the projections 65, and further typically in a friction holding fashion. It is also understood that, in addition to the channel defining portions, other means for securing the graphics/advertisement displays can be utilized, these including clips, hooks or other types of fasteners.

Figure 5:
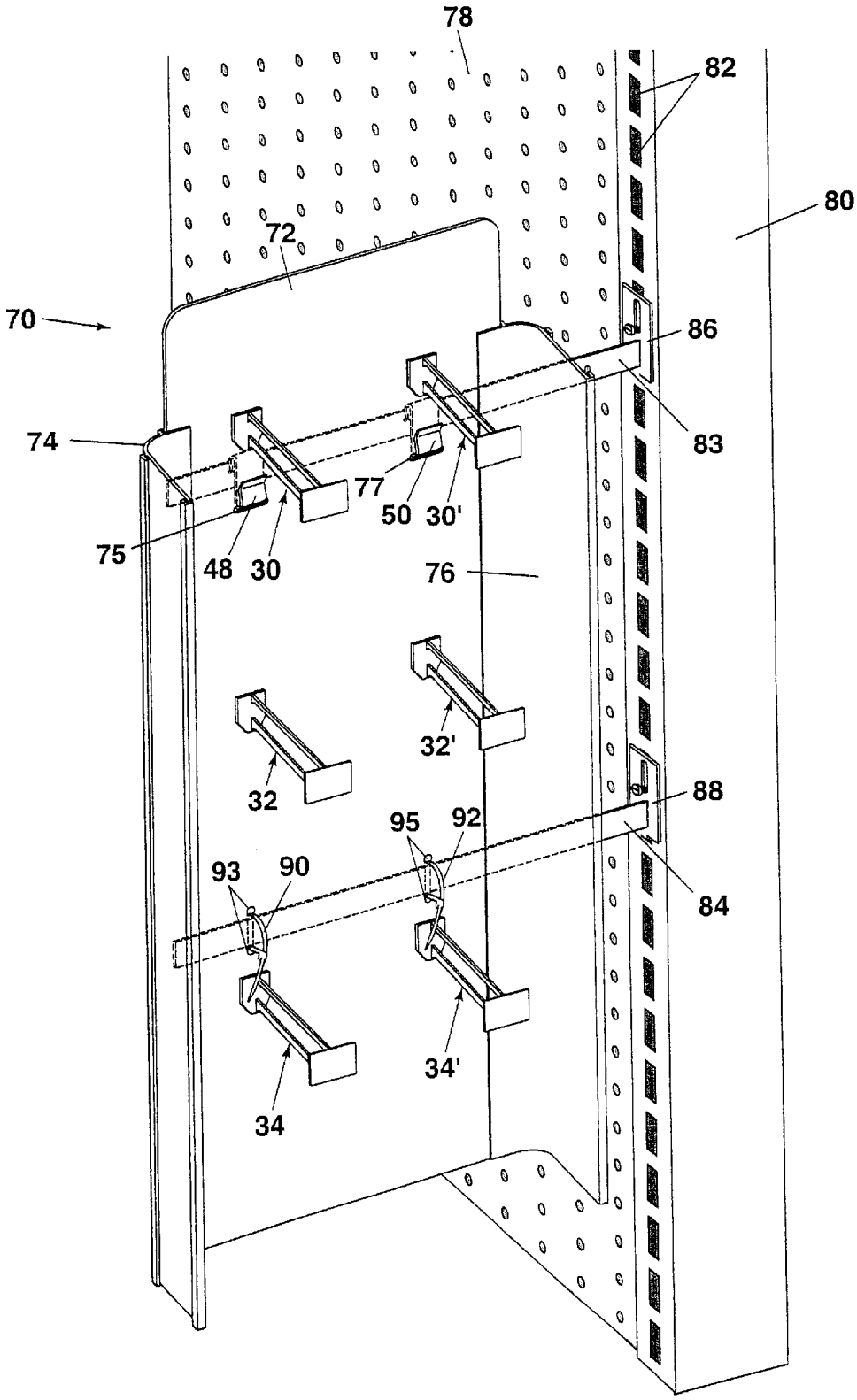
FIG. 5 is an environmental view, in perspective, of the product display assembly according to a further application of the present invention and which is secured, by virtue of first and second spaced apart and horizontally extending arms, to a single-slotted and vertically extending back plate of the conventional gondola upright.

Referring to FIG. 5 an environmental view, in perspective, is illustrated of a modified variant 70 of the product display assembly according to a further application of the present invention. The product display 70 includes a modified and widened back panel 72, to opposite ends of which are engaged first 74 and second 76 side panels. The side panels 74 and 76 are constructed substantially identically to those illustrated and described at 52 and 54 in the first preferred variant such that a repetitive description is unnecessary.

Additionally, the back panel 72 includes two individual and vertically extending rows of closely spaced apertures defined therethrough which are hidden from view but are evidenced by the engagement of separate rows 30, 32, 34 and 30', 32', 34' of the product display hangers in the manner indicated in FIG. 5. It is also envisioned that the individual rows of apertures can also be defined by widened slotted portions and reference is made to slots 75 and 77 defined towards the upper end of the back panel 72 in FIG. 5.

The conventional gondola upright in FIG. 5 includes such features as a pegboard surface 78 and, more particularly relevant to the indicated variant, a vertically extending back plate 80 including, on a specified face thereof, a plurality of single and spaced apart slots 82. The product display variant 70 includes a pair of first 83 and second 84 spaced apart and horizontal/elongate extending support arms.

Each of the support arms 83 and 84 is preferably defined as a substantially flatted plate in cross section and each terminates at a mounting end in a single slot mounting portion, see further at 86 for arm 83 and at 88 for arm 84, the single slot mounting portions in turn being engageable with selected ones of the vertically spaced apart and extending apertures 82 of the single-slotted and vertically extending back plate of the conventional gondola upright. The back panel 72 of the display variant 70 is secured in abutting fashion to the elongate extending arms 83 and 84 and, viewing the first arm 83, this is accomplished again through the use of the "S" shaped mounting clips 48 and 50 as previously described and which engage, through opposite ends with both the slotted portions 75 and 77 in the back panel 72 and extending locations of the arm 83. Referring to the second extending arm 84 in FIG. 5, tie straps 90 and 92 are employed to extend through additional holes (or pairs of holes 93 and 95 as illustrated) and in order to affix the product display 70 securely to the extending arms 83 and 84.

Figure 6:
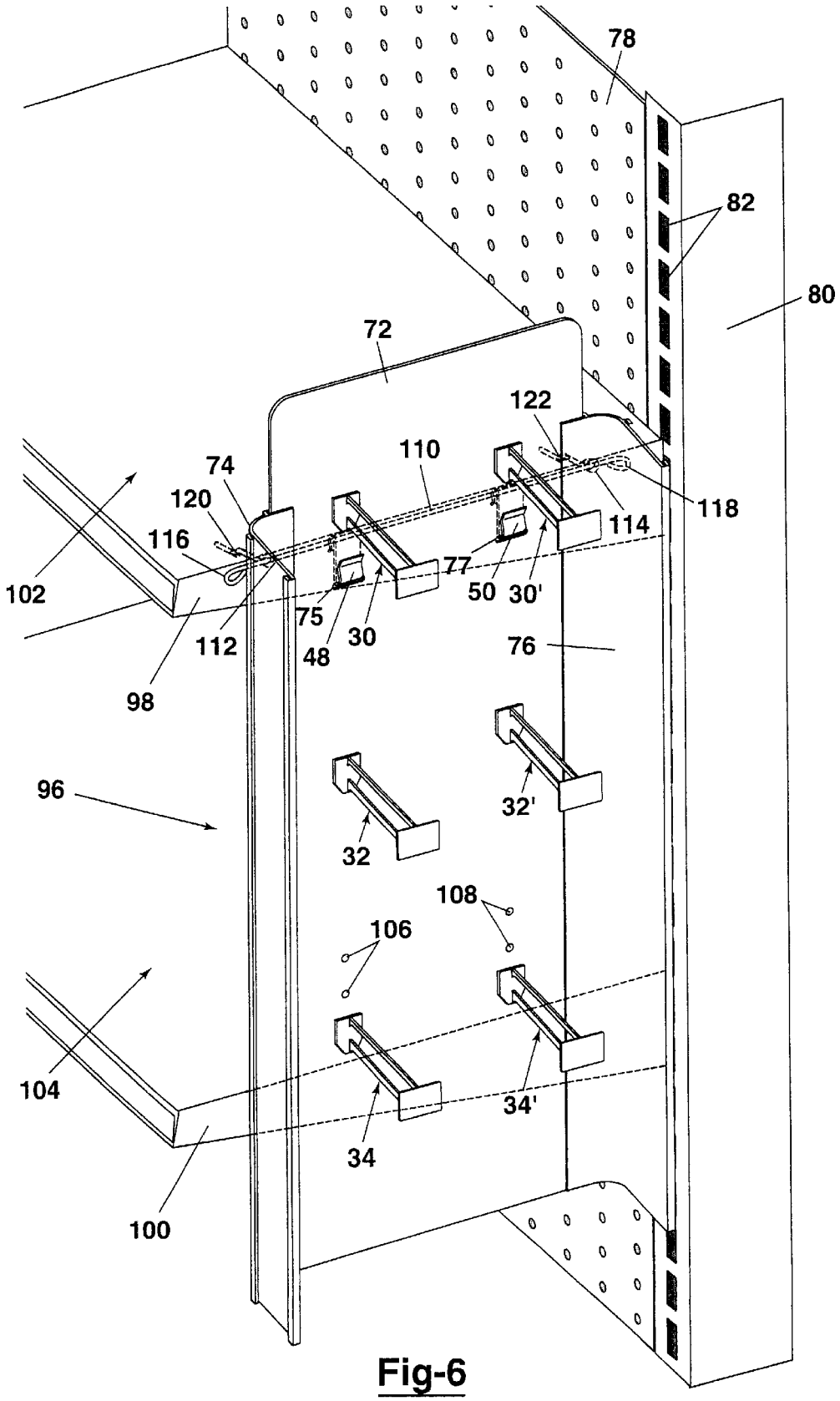
FIG. 6 is an environmental view, in perspective, of the product display assembly according to a yet further application of the present invention and which is secured to side extending edges of the shelving portions associated with the conventional gondola upright.

Referring now to FIG. 6, an environmental view is illustrated in perspective at 96 of a further mounting variation of the product display assembly according the present invention and which is secured to side extending edges 98 and 100, respectively, of associated shelving portions 102 and 104 of the conventional gondola upright. As with the variant described in reference to FIG. 5, the existing gondola support again includes a pegboard surface 78 and, more particularly relevant to the indicated variant, a vertically extending back plate 80 including, on a similarly specified face thereof, a plurality of single and spaced apart slots 82.

The display assembly in the mounting application 96 is again as substantially illustrated in the variant of FIG. 5 and includes the modified and widened back panel 72, to the opposite ends of which are engaged the first 74 and second 76 side panels. The back panel 72 again includes two individual and vertically extending rows of closely spaced apertures, represented in FIG. 6 at 106 and 108, and which support individual ones of the rows 30, 32, 34 and 30', 32', 34' of the product display hangers in the manner indicated. It is again envisioned that the individual rows of apertures can also be defined by widened slotted portions and reference is made to identically configured slots 75 and 77 defined towards the upper end of the back panel 72 in FIG. 6.

The "S" shaped mounting clips 48 and 50 are again indicated, as previously described, and engages through first selected ends with both the slotted portions 75 and 77 in the back panel 72. An elongated hanger is illustrated at 110 and which extends through apertures 112 and 114 defined in upper edge locations of the side panels 74 and 76. The hanger 110 also includes substantially looped ends 116 and 118 which provide abutting support between the product display and the shelving portions 102 and 104. Terminating portions of the looped ends 116 and 118, see respectively at 120 and 122, extend through associated apertures located in the top edge surface of the shelving portion (in this case the upper shelf indicated at 102) concurrently with second selected and curved ends of the mounting clips 48 and 50 engaging intermediate locations of the hanger 110 to support the display assembly.

Figure 7:
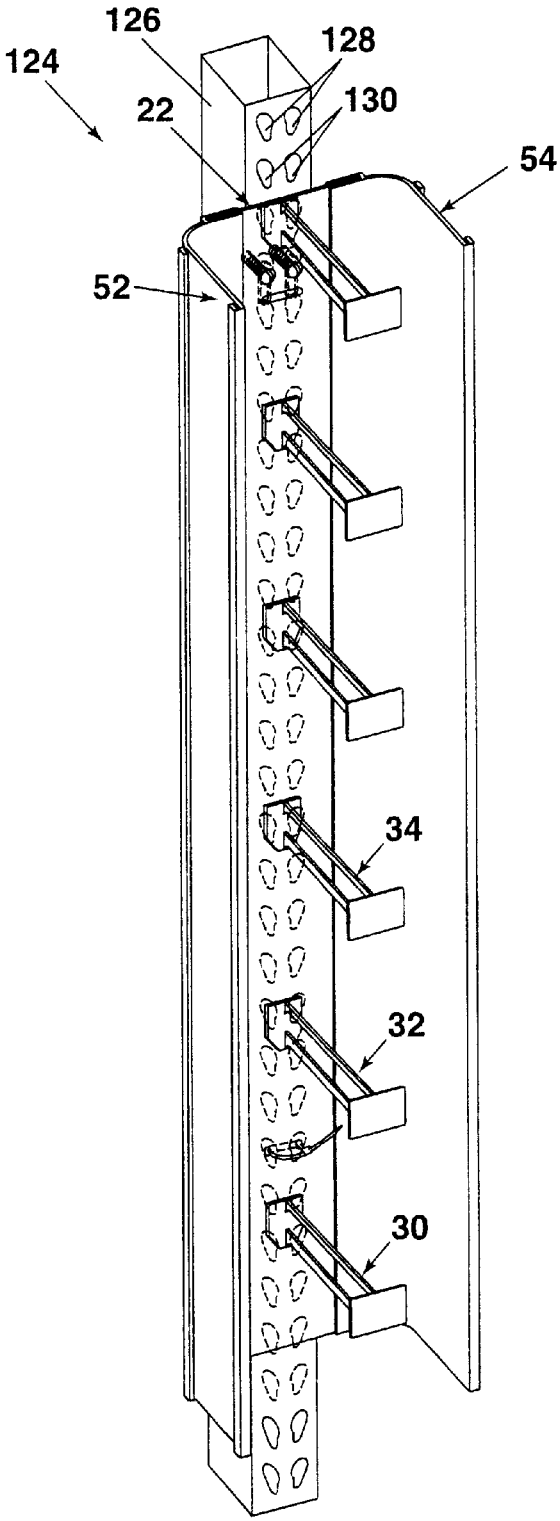
FIG. 7 is a yet further environmental view, again in perspective, of the product display assembly according to a still further application of the present invention and which is secured to a vertically extending and double slotted back plate.

Finally, and referring to FIG. 7 is a yet further environmental view is illustrated in perspective at 124 of an application of the product display assembly according to a still further variant. In the variant 124, the conventional support includes a vertically extending back plate 126, upon a selected face of which is defined double slotted rows of apertures 128, 130, et seq. in a vertical direction of the back plate 126 from a top end downwardly.

The product display in the application of FIG. 7 is substantially as previously described and again includes a back panel 22 and arcuately configured and affixable side panels 52 and 54. As also previously described, display hangers 30, 32, 34, et seq. are provided and the associated pairs of rearwardly extending and angled tabs (see again at 42 such as in the exploded view of FIG. 2) each insert within and abuttingly engage a selected horizontally disposed pair of the apertures defined in the back plate 126. Without limitation, other and additional mounting variants are possible for supporting the product display as described herein.

Having described my invention, additional preferred embodiments will become apparent to those skilled in the art to which it pertains and without deviating from the scope of the appended claims.

I claim:

1. In combination, a product display assembly and an upwardly extending support surface, said display assembly comprising:

a substantially planar shaped and elongate extending back panel, a plurality of apertures being formed through said back panel at spaced apart intervals, said apertures receiving inserting ends of product display hangers;

a first side panel and a second side panel, each of said side panels being elongate extending and each further exhibiting an arcuate bend in cross section;

engaging means for securing axially extending elongate and cross sectionally arcuate extending edges of said side panels to opposite extending side edges of said back panel and by which said side panels extend outwardly with respect to said back panel; and receiving means associated with said side panels for supporting and displaying advertisement placards.

2. The product display assembly as described in claim 1, said engaging means further comprising clasp portions defined along said axially extending and arcuate extending edges of said side panels, said opposite extending edges of said back panel insertingly engaged between inwardly facing surfaces of said clasp portions.

3. The product display assembly as described in claim 2, further comprising serrations extending from at least one of said inwardly facing surfaces of said clasp portions, said serrations resistively engaging said side edges of said back panel.

4. The product display assembly as described in claim 1, said receiving means further comprising spaced apart and opposing channel defining portions extending along a length of at least one facing surface of each of said side panels.

5. The product display assembly as described in claim 1, the upwardly extending support surface further defining a wing rack assembly having a surface defined by a plurality of spaced apart grid portions, said inserting ends of said product display hangers including angled tabs which, upon insertion through said back panel, engage a selected one of the spaced apart grid portions.

6. The product display assembly as described in claim 5, further comprising elongated slots defined in the back panel at spaced apart intervals, mounting clips being configured in a modified "S" shape and, upon insertion through an associated slot defined in said back panel, suspending said product display assembly from a further selected one of said grid portions.

7. The product display assembly as described in claim 1, the upwardly extending support surface further defining a single-slotted and vertically extending back plate, first and second spaced apart and horizontally extending arms extending from said back plate and engaging said back panel of said product display assembly.

8. The product display assembly as described in claim 1, the upwardly extending support surface further defining a vertically extending and double slotted back plate, said product display hangers extending through said back panel to support said product display assembly upon the double slotted back plate.

9. The product display assembly as described in claim 1, the upwardly extending support surface further defining a side extending edge of at least one shelving portion, said back panel being supported in abutting fashion upon the extending edges of the shelving portions.

10. The product display assembly as described in claim 1, said product display assembly exhibiting a specific size and shape, each of said back panel and said first and second side panels being constructed of a plasticized extrusion panel.

11. The product display assembly as described in claim 1, said product display assembly exhibiting a substantially "U" shape in cross section.

12. In combination, a product display assembly and an upwardly extending support surface, the upwardly extending support surface further defining a wing rack assembly having a surface defined by a plurality of spaced apart grid portions, said product display assembly comprising:

a substantially planar shaped and elongate extending back panel, a plurality of apertures being farmed through said back panel at spaced apart intervals, said apertures receiving inserting and engaging ends of product display hangers;

a first side panel and a second side panel, each of said side panels being elongate extending and substantially planar, a portion of each of said panels further exhibiting an arcuate shape in cross section;

engaging means for securing said arcuate extending portions of said side panels to opposite extending side edges of said back panel and so that said side panels extend outwardly from said back panel, said engaging means further comprising spaced apart clasp portions defined along said arcuate extending edges of said side panels, said opposite extending edges of said back panel insertingly engaged between inwardly facing surfaces of said clasp portions; and receiving means associated with said side panels for supporting and displaying advertisement placards, said receiving means further comprising spaced apart and opposing channel defining portions extending axially along at least outwardly facing surfaces of said side panels.

* * * * *